US006111594A

United States Patent [19]

Jeong

[11] Patent Number: 6,111,594

[45] Date of Patent: Aug. 29, 2000

[54] METHOD OF AND APPARATUS FOR CONTROLLING TRANSFER VOLTAGE BASED ON SPECIFIC RESISTANCE OF PAPER IN LASER BEAM PRINTER

[75] Inventor: Su-Jong Jeong, Kumi, Rep. of Korea

[73] Assignee: SamSung Electronics Co., Ltd., Suwon, Rep. of Korea

[21] Appl. No.: 09/333,967

[22] Filed: Jun. 16, 1999

[30] Foreign Application Priority Data

Jan. 11, 1999 [KR] Rep. of Korea ..... 99-377

[51] Int. Cl.[7] ..... G03G 13/04

[52] U.S. Cl. ..... 347/140; 399/45; 399/66

[58] Field of Search ..... 347/140, 157; 399/45, 48, 66, 297, 318

[56] References Cited

U.S. PATENT DOCUMENTS

| | | | |
|---|---|---|---|
| 3,816,756 | 6/1974 | Brensnick | 307/149 |
| 4,511,240 | 4/1985 | Suzuki et al. | 399/48 |
| 5,056,042 | 10/1991 | Lieb | 364/519 |
| 5,099,287 | 3/1992 | Sato | 399/45 |
| 5,155,501 | 10/1992 | Fujita et al. | 347/158 |
| 5,241,343 | 8/1993 | Nishio | 399/90 |
| 5,486,903 | 1/1996 | Kanno et al. | 399/45 |
| 5,809,367 | 9/1998 | Yoo et al. | 399/45 |
| 5,848,321 | 12/1998 | Roh et al. | 399/45 |
| 5,887,220 | 3/1999 | Nagaoka | 399/46 |
| 5,905,925 | 5/1999 | Kawabata et al. | 399/45 |
| 5,909,605 | 6/1999 | Nishizawa et al. | 399/66 |
| 5,953,556 | 9/1999 | Yamanaka | 399/66 |

FOREIGN PATENT DOCUMENTS

| | | |
|---|---|---|
| 0 660 197 | 6/1995 | European Pat. Off. . |
| 0 666 509 | 8/1995 | European Pat. Off. . |
| 57-64270 | 4/1982 | Japan . |
| 6-19334 | 1/1994 | Japan . |
| 2257658 | 1/1993 | United Kingdom . |

*Primary Examiner*—N. Le
*Assistant Examiner*—Lamson D. Nguyen
*Attorney, Agent, or Firm*—Robert E. Bushnell, Esq.

[57] ABSTRACT

A method of and apparatus for controlling a transfer voltage based on a paper specific resistance in a laser beam printer is provided. In the transfer voltage controlling method, the resistance of the feed rollers is detected as a first resistance before a paper sheet passes between the feed rollers. The resistance of the paper sheet and the feed rollers is detected as a second resistance when the paper sheet passes between the feed rollers. The specific resistance of the paper sheet is obtained as a third resistance by determining the difference between the first resistance and the second resistance. The resistance between a transfer roller and a photosensitive drum is detected as a fourth resistance before the paper sheet passes through the transfer roller. A composite resistance is detected as a fifth resistance by adding the third resistance to the fourth resistance, and the paper sheet is printed by applying a transfer voltage to the transfer roller based on the fifth resistance.

36 Claims, 6 Drawing Sheets

METHOD OF AND APPARATUS FOR CONTROLLING TRANSFER VOLTAGE BASED ON SPECIFIC RESISTANCE OF PAPER IN LASER BEAM PRINTER

This application makes reference to, incorporates the same herein, and claims all benefits accruing under 35 U.S.C. §119 from my application METHOD OF CONTROLLING TRANSFER VOLTAGE BASED ON SPECIFIC RESISTANCE OF PAPER IN LASER BEAM PRINTER filed with the Korean Industrial Property Office on Jan. 11, 1999 and there duly assigned Serial No. 377/1999.

BACKGROUND OF THE INVENTION

1. Field of the Invention

The present invention relates to a laser beam printer (LBP), and in particular, to a method of controlling provision of a transfer voltage based on the specific resistance of paper in n laser beam printer (LBP).

2. Description of the Related Art

In general, a laser beam printer (LBP) exemplary of contemporary practice in the art includes a paper cassette and an image forming device such as a developer and a fixer for fixing a toner image onto a paper sheet, to print on the paper.

In a general laser beam printer (LBP) exemplary of contemporary practice in the art, plural sheets of paper loaded on a paper cassette are fed sheet by sheet by a pickup roller. Then, the paper reaches a pair of feed rollers with its leading end aligned, and a toner image is fixed onto the paper with high temperature and high pressure while the paper passes through a developer and a fixer. The image-formed paper comes out to a discharge plate through a discharge roller.

The above described laser beam printer (LBP) exemplary of contemporary practice in the art typically uses a conductive transfer roller, measures the specific resistance of the transfer roller varied with an environment, and applies a transfer voltage based on the transfer roller resistance. In fact, image quality is greatly affected by a variation in the specific resistance of paper, which is in turn influenced by the thickness, humidity, and quality of the paper. However, despite the great influence on image quality, the paper specific resistance is unduly neglected in the process of setting a transfer voltage in the laser beam printer (LBP) exemplary of contemporary practice in the art which gives consideration only to the resistance between the conductive transfer roller and a photosensitive drum.

U.S. Pat. No. 4,511,240 to Suzuki et al., entitled ELECTROSTATIC RECORDING APPARATUS, discloses an electrostatic recording apparatus having a sensor for detecting a surface potential of a photosensitive member on which an electrostatic latent image is formed and a controller for controlling a developing bias voltage in accordance with the detected surface potential. The developing bias voltage includes an AC component and a DC component which are selectively used in accordance with a latent image potential. It is disclosed that the frequency of the AC developing bias and the magnitude of the DC developing bias are variable so that an optimum quality of image is reproduced.

U.S. Pat. No. 5,099,287 to Sato, entitled TRANSFERRING VOLTAGE CONTROL SECTION, discloses an electrophotographic printing apparatus which includes a paper supplying mechanism for supplying recording paper, and a transferring section for charging the recording paper supplied from the paper supplying mechanism by means of a transferring voltage and for transferring development material adhered to the surface of a charging body of the apparatus to the charged recording paper. It is disclosed that the electrophotographic printing device further includes a transferring voltage control section for controlling the transferring voltage level according to the type of the recording paper.

U.S. Pat. No. 5,155,501 to Fujita et al., entitled ELECTROPHOTOGRAPHIC APPARATUS WITH FREQUENCY AND DUTY RATIO CONTROL, discloses an electrophotographic apparatus wherein a photosensitive body charged by a charger is exposed to light emitted from an exposer, for the formation of an electrostatic latent image, and wherein the electrostatic latent image is developed by a developer and the image developed by the developer is transferred on a paper sheet by a transfer charger. It is also disclosed that the transfer charger of the apparatus is made up of a converter transformer, a switching circuit for controlling the excitation of the converter transformer, and an error detector, arranged in association with the converter transformer, for detecting an error voltage corresponding to a transfer voltage. The apparatus is disclosed to include a separately (or externally) excited converter which outputs the transfer voltage from the secondary winding of the converter transformer, an input section from which one of the print density levels that are predetermined stepwise is designated, and a control section for controlling the frequency and duty ratio of a transfer signal used for causing the switching circuit to perform a switching action, in accordance with the print density level designated from the input section and the error voltage information supplied from the error detector.

U.S. Pat. No. 5,241,343 to Nishio, entitled CONDUCTIVE FOAM RUBBER ROLLER USED IN IMAGE FORMATION APPARATUS SUCH AS ELECTROPHOTOGRAPHIC APPARATUS, discloses an image formation apparatus such as an electrophotographic recording apparatus which uses a conductive foam rubber roller as a charging roller, developing roller, toner-removing roller, or transfer roller, and comprises a tubular roller element made of a conductive foam rubber material and having a central bore defined by a solid skin layer having an electric resistivity considerably higher than that of a foam structure of the rubber element, and a conductive shaft on which the roller element is mounted and fixed. It is disclosed that end sections of the skin layer are removed from the roller element such that the foam structure thereof is in direct contact with the shaft at end sections of the bore thereof. Alternatively, a conductive disc-like member having a central opening formed therein is inserted onto the shaft to be abutted against an end face of the roller element, whereby sufficient electric contact can be established between the roller element and the shaft.

U.S. Pat. No. 5,486,903 to Kanno et al., entitled IMAGE FORMING APPARATUS WITH PAPER THICKNESS DETECTOR, discloses a detection device for detecting the thickness of a recording material by using an air capacitor, and an image forming device for forming an image on the recording material on the basis of the output from the detection device.

U.S. Pat. No. 5,809,367 to Yoo et al., entitled METHOD OF AUTOMATICALLY CONTROLLING TRANSFER VOLTAGE AND FUSING TEMPERATURE IN AN ELECTROPHOTOGRAPHIC PRINTING APPARATUS, discloses a method of automatically controlling an electrophotographic printing apparatus' transfer voltage and fusing temperature according to the type of paper by an automatic mode change during manual paper feeding which includes the steps of following a manual feed option being selected, automatically converting the apparatus's normal paper mode into a paper selection mode in response to the manual paper feeding; and when a keyboard input is made indicating a change in the type of paper, setting the transferring voltage and fusing temperature according to the keyboard input and printing images corresponding to image data from a host computer system on the paper.

U.S. Pat. No. 5,848,321 to Roh et al., entitled METHOD FOR AUTOMATICALLY CONTROLLING TRANSFER VOLTAGE IN PRINTER USING ELECTROPHOTOGRAPHY SYSTEM, discloses an electrophotography machine that consistently produces images of optimum image density regardless of whether an ordinary sheet of paper or a transparency is used as the recording medium. A photosensor activated in response to the recording media passing a first sensor is disclosed to be positioned on the paper conveyance path and detects whether or not the recording media being processed is an ordinary sheet of paper or a transparency. It is further disclosed that a controller automatically applies the appropriate transfer voltage depending on whether or not the sheet of recording media is a sheet of paper or a transparency.

U.S. Pat. No. 5,887,220 to Nagaoka, entitled ELECTROPHOTOGRAPHIC PRINTER SENSING AMBIENT CONDITIONS WITHOUT SENSORS, discloses when an electrophotographic printer is manufactured, the initial electrical resistance of its transfer roller is measured and a corresponding value is stored in a memory device in the printer during operation, the printer's control program estimates the resistance of the transfer roller from the stored value, taking aging into account, then measures the actual resistance of the transfer roller, and infers ambient conditions from the difference between the estimated and actual resistance values. It is also disclosed that the electrophotographic printer is controlled according to the inferred ambient conditions.

SUMMARY OF THE INVENTION

An object of the present invention is to provide a method and apparatus for efficiently controlling a transfer voltage based on a paper specific resistance in a high-speed laser beam printer (LBP), to prevent degradation of image quality caused by a variation in the paper specific resistance.

Another object of the present invention is to provide a method and apparatus for controlling a transfer voltage based on a paper specific resistance in an laser beam printer (LBP), to obtain high-quality images.

To achieve the above and other objects or the present invention, there is provided a method of controlling a transfer voltage based on a paper specific resistance in a laser beam printer. In the transfer voltage controlling method, the resistance of feed rollers is detected as a first resistance before a paper sheet passes between the feed rollers, and the resistance of the printing medium, such s as a paper sheet, and the feed rollers is detected as a second resistance when the paper sheet passes between the feed rollers. The specific resistance of the printing medium, such as a paper sheet, is obtained as a third resistance by calculating the difference between the first and second resistances. The resistance between a transfer roller and a photosensitive drum is detected as a fourth resistance before the printing medium, such as a paper sheet, passes through the transfer roller. A composite resistance is detected as a fifth resistance by adding the third resistance to the fourth resistance, and the printing medium, such as a paper sheet, is printed by applying a transfer voltage to the transfer roller based on the fifth resistance.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbol ate the same or similar components, wherein.

DETAILED DESCRIPTION OF THE PREFERRED EMBODIMENTS

Figure 1:
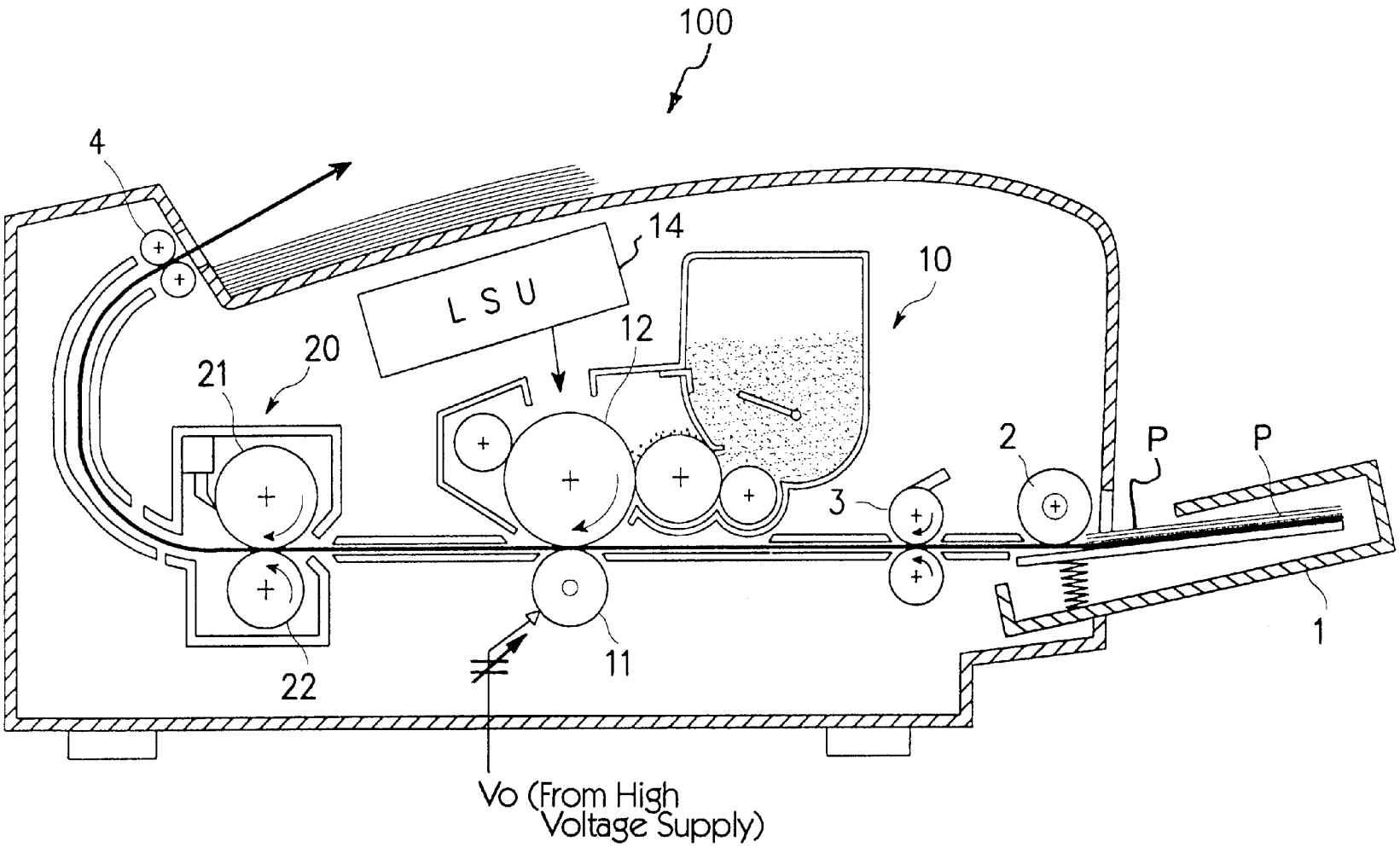
FIG. 1 is a schematic diagram of a laser beam printer (LBP) illustrating an embodiment of the present invention.

FIG. 1 is a schematic diagram of a laser beam printer (LBP) 100 illustrating an embodiment of the present invention including feed rollers 3, a transfer roller 11, a photosensitive drum 12, and a scanner unit 14, such as a laser scanner unit. Referring to FIG. 1, plural sheets of paper P loaded on a paper cassette 1 are fed sheet by sheet by a pickup roller 2. Then, the paper P reaches a pair of feed rollers 3 with its leading end aligned, and a toner image is fixed onto the paper P with high temperature and high pressure while the paper P passes first through a developer 10 and then a fixer 20 having fixing rollers 21 and 22. The image-formed paper P comes out to a discharge plate through a discharge roller 4. The laser beam printer (LBP) 100 of FIG. 1 typically uses a conductive transfer roller 11, and applies a transfer voltage Vo from a high voltage supply, such as high voltage supply 210 (FIG. 2), based on a printing medium specific resistance, such as a paper specific resistance.

Figure 2:
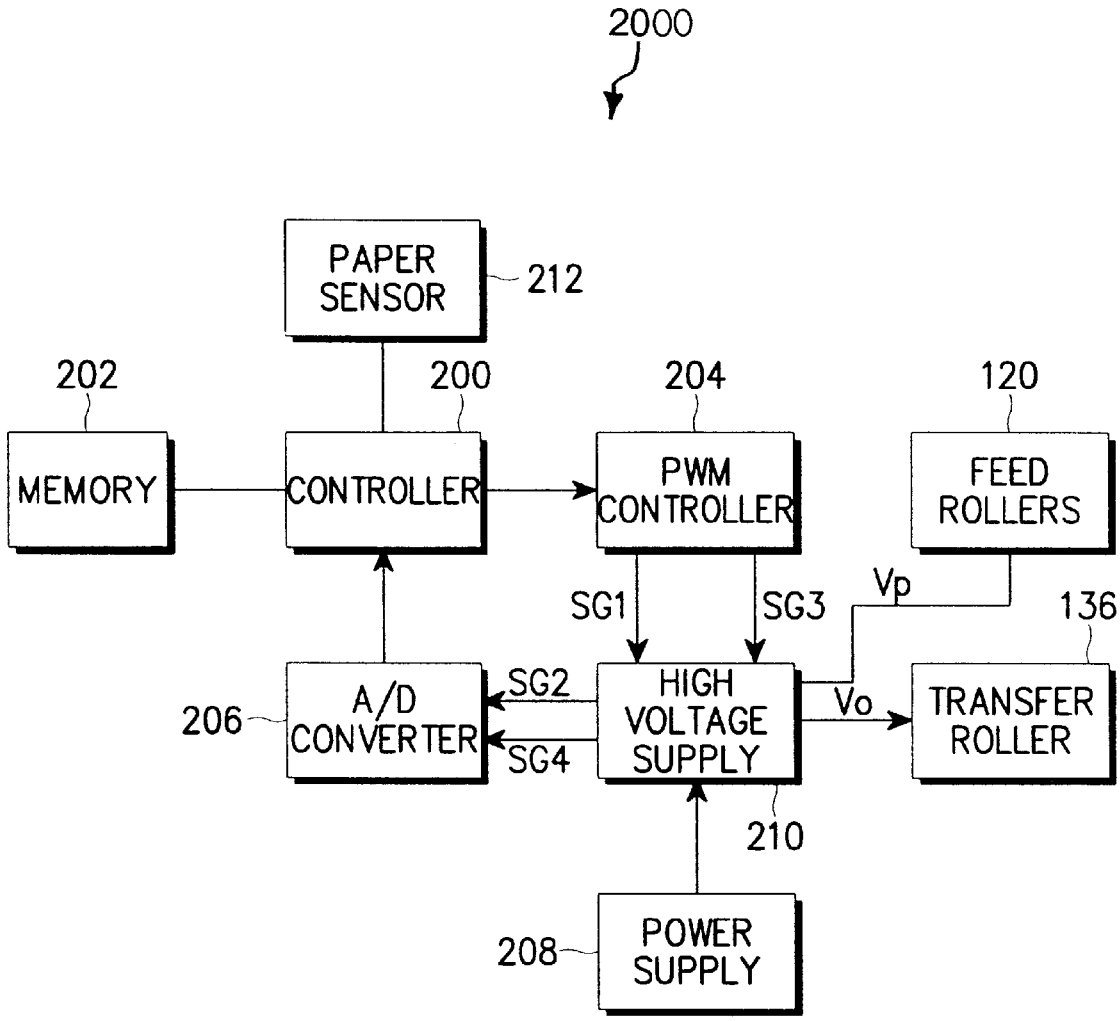
FIG. 2 is a block diagram of an laser beam printer (LBP) according to an embodiment of the present invention.
Figure 5:
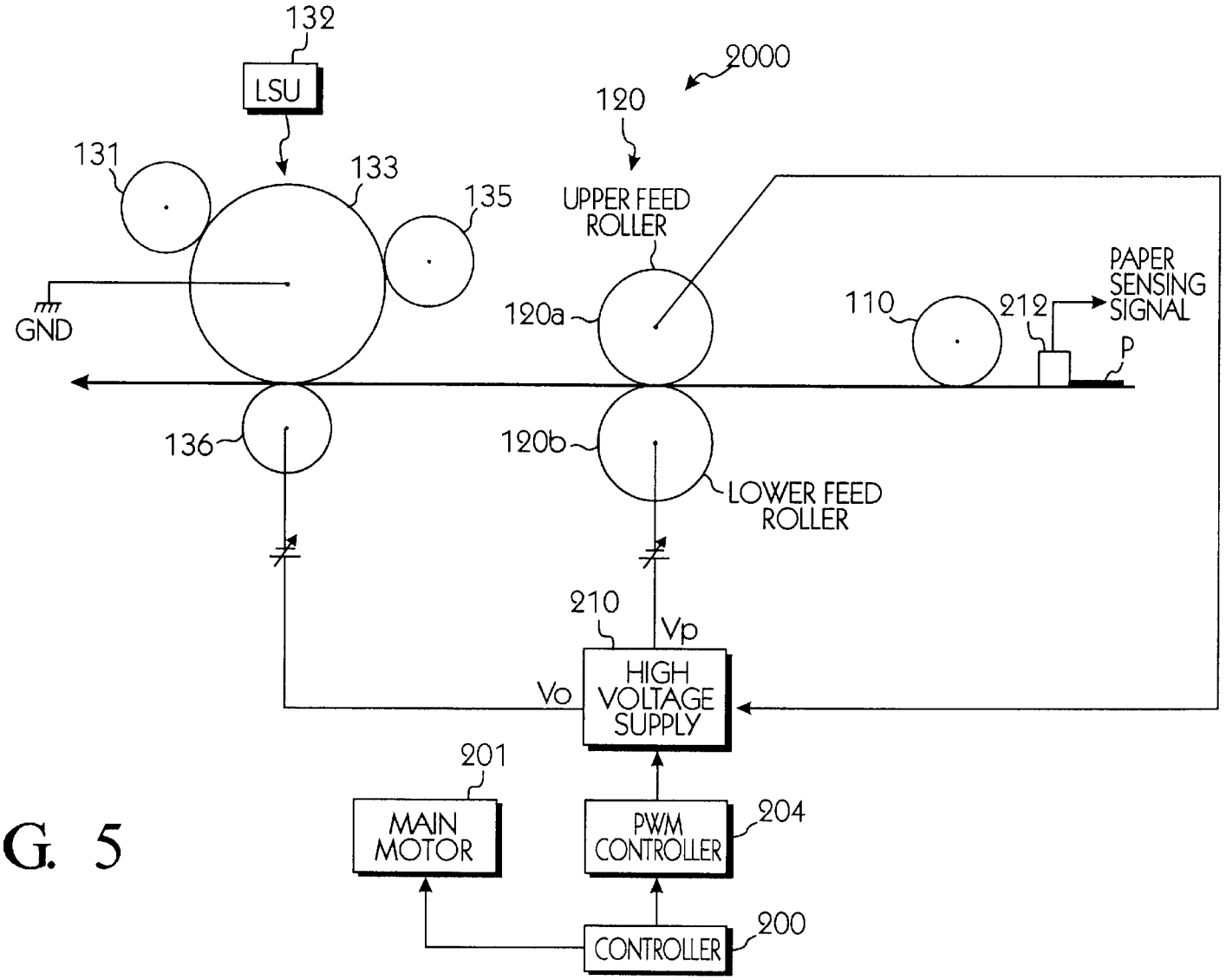
FIG. 5 is a schematic diagram of a laser beam printer (LBP) for describing a transfer operation based on of a paper specific resistance according to an embodiment of the present invention.

Referring to FIG. 2, FIG. 2 is a block diagram illustration of a laser beam printer (LBP) 2000 according to an embodiment of the present invention. A controller 200, such as a central processing unit (CPU) or a microprocessor, for example, of laser beam printer (LBP) 2000 according to an embodiment of the present invention provides an overall control in recording an image on a printing medium, such as a paper sheet P. Also, the controller 200 generates a pulse width modulation (PWM) control signal for controlling a high voltage Vp which is to be applied to feed rollers 120 for use in measurement of the specific resistance of the printing medium, such as paper sheet P, and another pulse width modulation (PWM) control signal for controlling provision of a transfer voltage Vo used in detecting the resistance between a photosensitive drum 133 and a transfer roller 136 (FIG. 5). A memory 202 has a read-only memory (ROM) for storing a program used to control provision of the transfer voltage Vo and a random access memory (RAM) for temporarily storing information to be printed or voltage values used for determining a composite resistance of the printing medium specific resistance, such as the paper specific resistance, and the transfer roller-photosensitive drum resistance. A pulse width modulation (PWM) controller 204 outputs pulse amplitude modulation (PAM) signals SG1 and SG3 in response to the pulse width modulation (PWM) control signals received from the controller 200. The controller 200 and the pulse width modulation (PWM) controller 204 can also be combined into a single controller, as desirable. A power supply 208 outputs different voltages for input of AC (Alternating Current) voltage. Upon receipt of the voltage from the power supply 208, the high voltage supply 210 generates a feed roller voltage Vp corresponding to the pulse amplitude modulation (PAM) signal SG1 received from the pulse width modulation (PWM) controller 204, the transfer voltage Vo corresponding to the pulse amplitude modulation (PAM) signal SG3, a voltage SG2 for use in detecting the printing medium specific resistance, such as the paper specific resistance, and a voltage SG4 indicative of the transfer roller-photosensitive drum resistance resulting from applying the transfer voltage Vo to the transfer roller 136. An A/D (analog-to-digital) converter 206 converts the voltage SG2 or the voltage SG4 received from the high voltage supply 210 to a digital signal and feeds the digital signal to the controller 200. A printing medium sensor, such as paper sensor 212, senses the introduction of the leading edge of the printing medium, such as the paper P, between the feed rollers 120 and applies a signal representing the sensed result to the controller 200.

Figure 3:
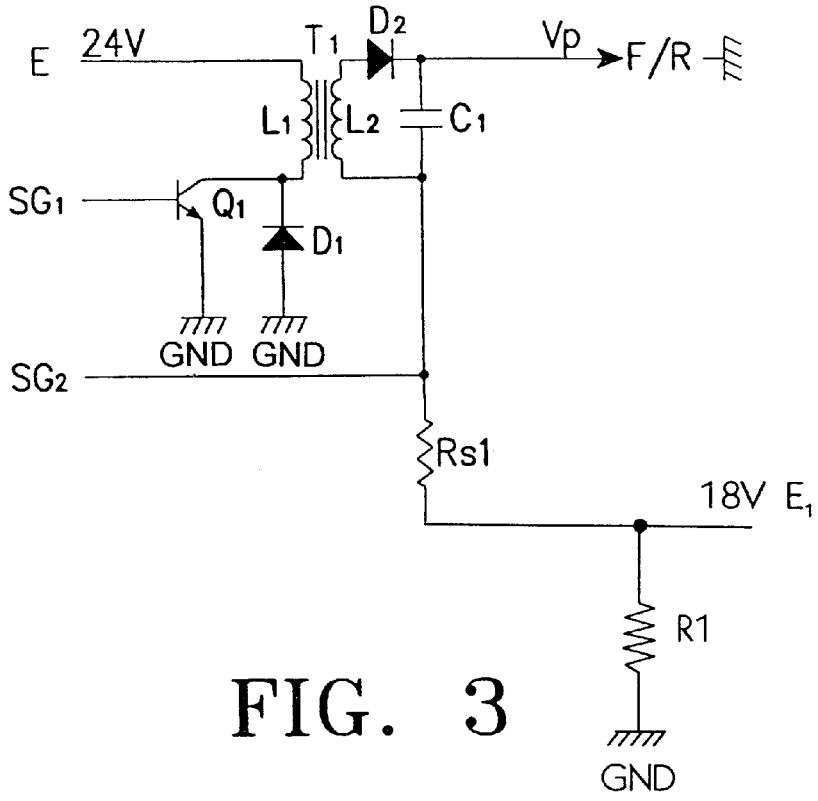
FIGS. 3 and 4 are detailed partial circuit diagrams of a high voltage supply according to a embodiment of the present invention.
Figure 4:
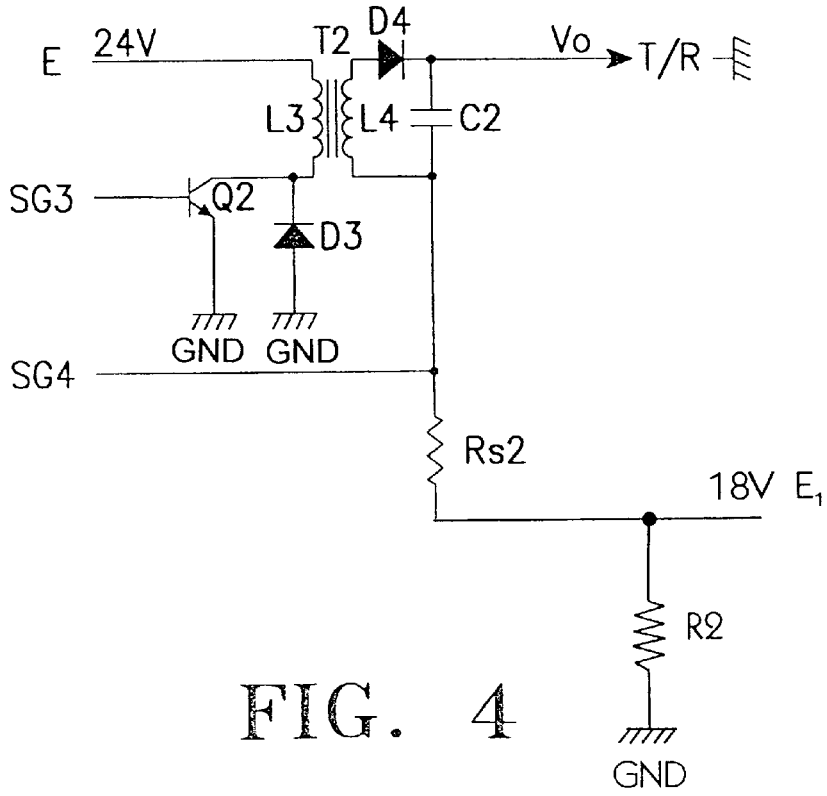

FIG. 3 is a detailed circuit diagram of a portion of the high voltage supply 210 of FIG. 2, from which the voltage Vp is applied to the feed rollers 120, and FIG. 4 is a detailed circuit diagram of a portion of the high voltage supply 210 of FIG. 2, from which the transfer voltage Vo is applied to the transfer roller 136.

Referring to FIG. 3, a transformer T1 includes a primary winding L1 for receiving a voltage E of 24 volts (V), for example, from the power supply 208 and a secondary winding L2 with a larger number of windings than those of the primary winding L1, for generating a higher voltage than a voltage on the primary winding L1. A diode D1 is coupled to the primary winding L1 and to ground GND, for clipping a voltage induced from the primary winding L1 to the secondary winding L2. A transistor Q1 has a base for receiving the pulse amplitude modulation (PAM) signal SG1 from the pulse width modulation (PWM) controller 204, a collector coupled to the primary winding L1, and an emitter that is grounded, for selectively controlling the voltage on the primary winding L1 to be induced to the secondary winding L2 based on the pulse amplitude modulation (PAM) signal SG1. A rectifying diode D2 has an anode coupled to the secondary winding L2, for rectifying the voltage induced to the secondary winding L2. A smoothing capacitor C1 smooths the rectified voltage and supplies the high voltage Vp at a predetermined level to the feed rollers (F/R) 120. A resistor Rs1, such as a 500kΩ resistor, for example, is coupled between the secondary winding L2 and the ground GND, for detecting a current flowing through the feed rollers 120 to provide a measure of the current flowing through the feed rollers 120. A resistor R1 is coupled between the resistor Rs1 and the ground GND, and a voltage $E_1$ of 18 volts (V), for example, is at the junction of the resistor R1 and the resistor Rs1. The voltage SG2 output for use in detecting the printing medium specific resistance, such as the paper specific resistance, is applied to the analog-to-digital (A/D) converter 206 based on the current flowing through the resistor Rs1.

Now referring to FIG. 4, a transformer T2 includes a primary winding L3 for receiving a voltage E of 24 volts (V), for example, from the power supply 208 and a secondary winding L4 with a larger number of windings than those of the primary winding L3, for generating a higher voltage than a voltage on the primary winding L3. A diode D3 is coupled to the primary winding L3 and to ground GND, for clipping a voltage induced from the primary winding L3 to the secondary winding L4. A transistor Q2 has a base for receiving the pulse amplitude modulation (PAM) signal SG3 from the pulse width modulation (PWM) controller 204, a collector coupled to the primary winding L3, and an emitter that is grounded, for selectively controlling the voltage of the primary winding L3 to be induced to the secondary winding L4 based on the pulse amplitude modulation (PAM) signal SG3. A rectifying diode D4 has an anode coupled to the secondary winding L4, for rectifying the voltage induced to the secondary winding L4. A smoothing capacitor C2 smooths the rectified voltage and supplies the transfer voltage Vo at a predetermined level to the transfer roller 136 (T/R). A resistor Rs2, such as 500kΩ resistor, for example, is coupled between the secondary winding L4 and the ground GND, for detecting a current flowing through the transfer roller 136 to provide a measure of the current flowing through the transfer roller 136, and thereby providing a measure of current between the transfer roller 136 and the photosensitive drum 133 (FIG. 5). A resistor R2 is coupled between the resistor Rs2 and the ground GND, and a voltage $E_1$ of 18 volts (V), for example, is at the junction of the resistor R2 and the resistor Rs2. The voltage SG4 output indicating the transfer roller-photosensitive drum resistance is applied to the analog-to-digital (A/D) converter 206 based on the current flowing through the resistor Rs2. Meanwhile, it is to be appreciated that while the high voltage supply circuitry or the high voltage supply 200 includes two circuits as shown in FIGS. 3 and 4 in a preferred embodiment of the present invention, it can be operable using a single circuit by controlling the input and output ports of the high voltage supply with a relay switch.

FIG. 5 is a schematic diagram of a laser beam printer (LBP) 2000 for describing a transfer operation based on a printing medium specific resistance, such as a paper specific resistance, according to an embodiment of the present invention. Referring to FIG. 5, a light source scanner unit 132, such as a laser scanner, produces an image on the photosensitive drum 133. A charge roller 131 charges the photosensitive drum 133, with toner being supplied to the photosensitive drum 133 by the developing roller 135. The feed rollers 120 including a upper feed roller 120*a* and lower feed roller 120*b*, are formed of a conductive rubber material, such as conductive rubber, and function to transfer the printing medium, such as the paper P, fed by a pickup roller 110 to the transfer roller 136. The upper feed roller 120*a* and lower feed roller 120*b* are in contact and the high voltage supply 210 supplies a current to the upper feed roller 120*a* and the lower feed roller 120*b*. When the pickup roller 110 is driven, the high voltage supply 210 flows a current through the upper feed roller 120*a* and lower feed roller 120*b*, so that the resistance of the feed rollers 120 themselves can be detected. The printing medium specific resistance, such as the paper specific resistance, can easily be determined by obtaining the difference between the currents on the feed rollers 120 upon presence of the printing medium, such as the paper P, between the feed rollers 120 and upon absence between the feed rollers 120 of the printing medium, such as the paper P. For obtaining the resistance of the feed rollers 120, the voltage Vp is a high potential voltage, for example, in a range of between 500 and 1000 volts (V), for example, and the material of the feed rollers 120 has a resistance at or below $1\times10^5\Omega$, for example, to resist against environment changes. Since the resistance between the photosensitive drum 133 and the transfer roller 136 is measured in a similar manner, the constitution of the laser beam printer (LBP) 2000 according to the present invention permits a low cost. In case the printing medium, such as the paper P, is rapidly fed, the printing medium resistance, such as the paper resistance, and the transfer roller resistance are separately measured. Alternatively, while there is a high voltage transfer system which can provide good quality images without influences from the paper resistance, a high cost is typically incurred.

By way of example, if the voltage Vp applied to the feed rollers 120 is 1000 volts (V) and a current of 0.1 milliampere (mA) is detected from the feed rollers 120 upon feeding the printing medium, such as the paper P, the resistance of the feed rollers 120 and the paper P as the printing medium is, for example, $10^7$ ohms (Ω) (=R=V/I=100 volts (V)/$1\times10^{-4}$ amperes (A)) under the Ohm's law (V=I×R). If the resistance of the feed rollers 120 upon absence of the paper P is, for example, $10^5$ ohms (Ω), the specific resistance of the paper P is $99\times10^5$ ohms (Ω) (=$10^7$ ohms (Ω)−$10^5$ ohms (Ω)). This measured paper specific resistance is fed to the transfer roller 136. In the exemplary contemporary practice in the art, since the transfer roller 136 operates according to a predetermined paper resistance, neglecting the resistance of a particular paper sheet, the image quality can therefore vary with the particular paper sheet or paper status. On the contrary, the present invention operates the transfer roller 136 according to the printing medium specific resistance, such as the paper specific resistance, obtained from the feed rollers 120.

Figure 6:
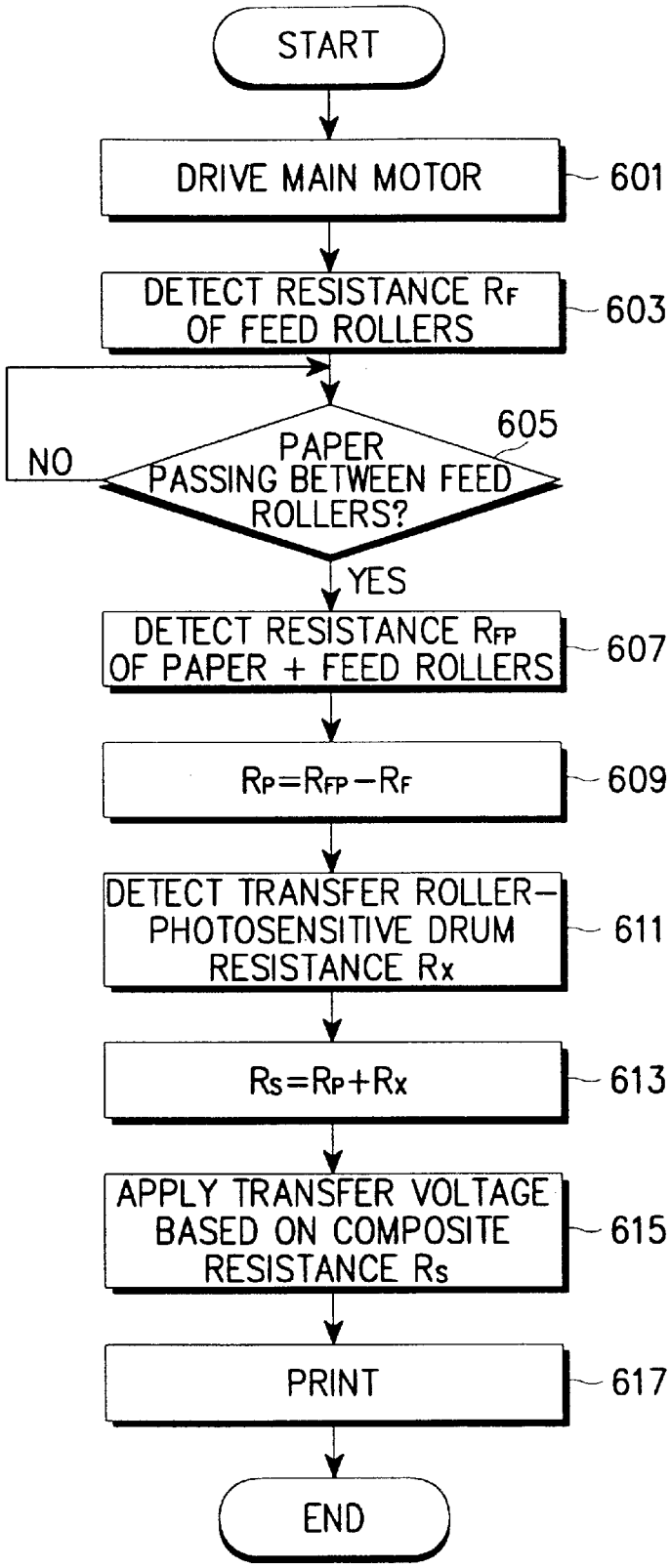
FIG. 6 is a flowchart of controlling provision of a transfer voltage depending on a paper specific resistance according to an embodiment of the present invention.
Figures 7A, 7B, 7C, 7D, 7E, 7F, 7G:
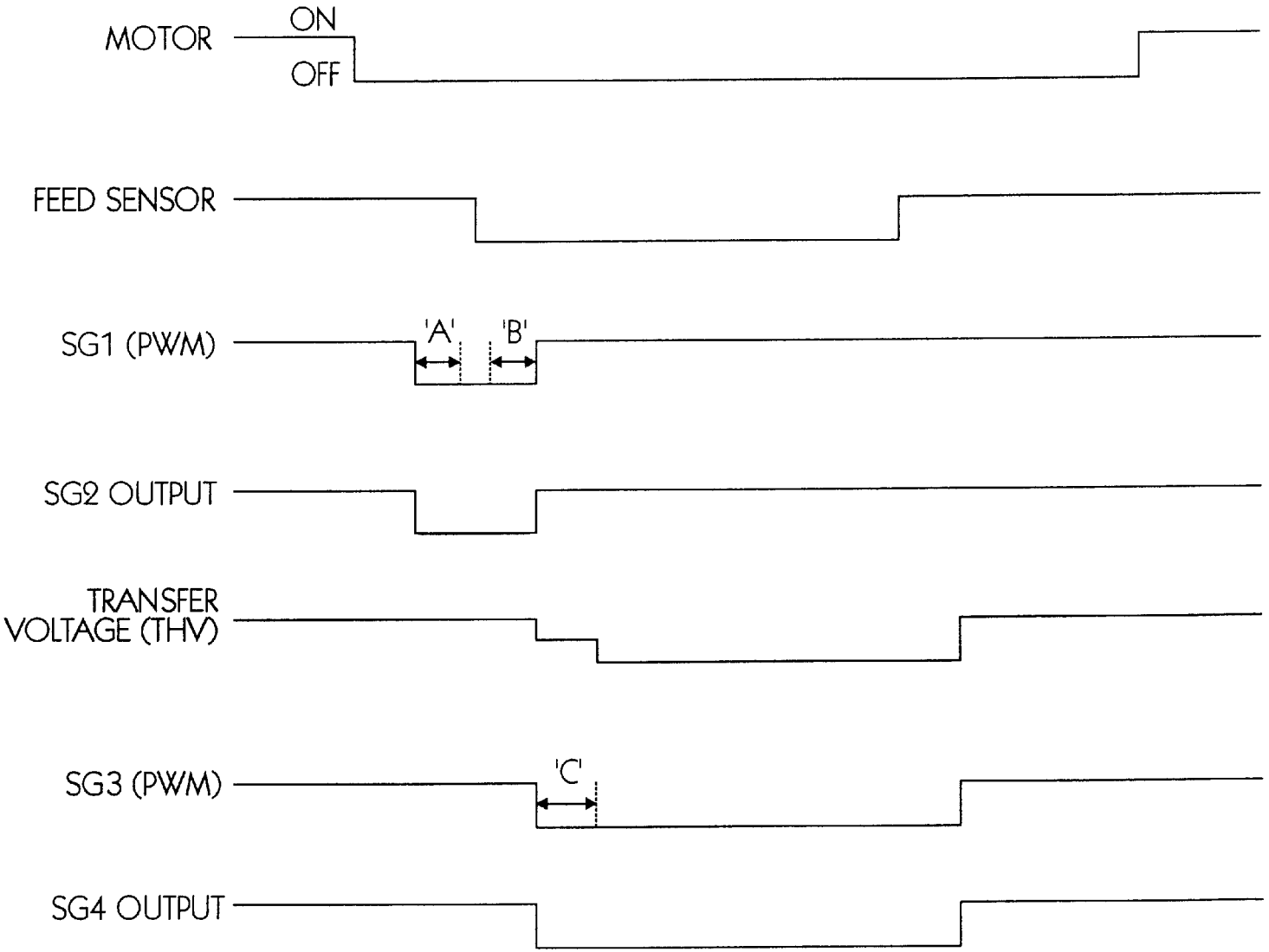
FIGS. 7A–7G are timing diagrams of signals according to an embodiment of the present invention.

Referring now to FIGS. 6 and 7, FIG. 6 is a flowchart of controlling a transfer voltage based on measurement or determination of the paper specific resistance according to a preferred embodiment of the present invention, and FIGS. 7A–7G are timing diagrams of signals according to an embodiment of the present invention. In FIGS. 7A–7G, FIG. 7A illustrates a timing diagram for a motor of laser beam printer (LBP) 2000; FIG. 7B illustrates a timing diagram for a printing medium sensor or paper sensor 212 (feed sensor); FIG. 7C illustrates a timing diagram for the pulse amplitude modulation (PAM) signal SG1 from pulse width modulation (PWM controller 204; FIG. 7D illustrates a timing diagram for the voltage SG2 resulting from applying the voltage Vp to the feed rollers for use in detecting the printing medium specific resistance, such as the paper specific resistance; FIG. 7E illustrates a timing diagram for the transfer voltage applied to the transfer roller 136; FIG. 7F illustrates a timing diagram for the pulse amplitude modulation (PAM) signal SG3 from pulse width modulation (PWM) controller 204; and FIG. 7G illustrates a timing diagram for the voltage SG4 indicative of the transfer roller-photosensitive drum resistance resulting from applying the transfer voltage Vo to the transfer roller 136. Also, in FIG. 7C, reference character A indicates a sensing period of the resistance of the feed rollers 120 themselves, reference character B in FIG. 7C indicates a sensing period of the resistance of the printing medium, such as the paper P, and the feed rollers 120, and reference character C in FIG. 7F indicates a sensing period of the resistance between the transfer roller 136 and the photosensitive drum 133.

Now, referring to FIGS. 2 to 7G, particularly to FIG. 6, there will hereinbelow be given a detailed description of provision of a transfer voltage based on a paper specific resistance as a printing medium specific resistance, for example, in a laser beam printer (LBP) according to a preferred embodiment of the present invention.

In step 601 of FIG. 6, the controller 200 drives a main motor 201. In step 603, the controller 200 feeds a pulse width modulation (PWM) control signal to the pulse width modulation (PWM) controller 204 to apply the pulse amplitude modulation (PAM) signal SG1 to the high voltage supply 210. The controller 200 and the pulse width modulation (PWM) controller 204 can be a central processing unit (CPU) or a microprocessor, for example and can be separate controllers or combined into a single controller, as desirable. The high voltage supply 210 then applies to the feed rollers 120 the voltage Vp corresponding to the pulse amplitude modulation (PAM) signal SG1 received from the pulse width modulation (PWM) controller 204 in response to a power supply voltage received from the power supply 208, for detecting the resistance of the feed rollers 120 alone. Specifically, the voltage SG2 resulting from applying the voltage Vp to the feed rollers 120 is converted to a digital signal in the analog-to-digital (A/D) converter 206, and the controller 200 detects the resistance $R_F$ of the feed rollers 120 from the digital signal received from the analog-to-digital (A/D) converter 206. The feed roller resistance $R_F$ is stored by the controller 200 in a predetermined area of the memory 202.

Subsequently, the controller 200 determines whether the paper P is passing between the feed rollers 120 by the paper sensor 212, in step 605 of FIG. 6. In step 607, the controller 200 detects the resistance $R_{FP}$ of the paper and the feed rollers when the paper P is passing between the feed rollers 120 and stores the resistance $R_{FP}$ in a predetermined area of the memory 202. In step 609, the controller 200 determines a paper specific resistance $R_P$ from the resistance the paper and feed rollers $R_{FP}$ and from the feed roller resistance $R_F$ as follows:

$$R_P=R_{FP}-R_F.$$

The paper specific resistance $R_P$ is stored by the controller 200 in a predetermined area of the memory 202.

In step 611 of FIG. 6, the controller 200 detects the resistance $R_X$ between the transfer roller 136 and the photosensitive drum 133. Specifically, the controller 200 generates a pulse width modulation (PWM) control signal to the pulse width modulation (PWM) controller 204 to apply the pulse amplitude modulation (PAM) signal SG3 to the high voltage supply 210. Then, the high voltage supply 210 applies to the transfer roller 136 the transfer voltage Vo corresponding to the pulse amplitude modulation (PAM) signal SG3 received from the pulse width modulation (PWM) controller 204 in response to a voltage received from the power supply 208, for detecting the resistance between the transfer roller 136 and the photosensitive drum 133. That is, the voltage SG4 resulting from applying the transfer voltage Vo to the transfer roller 136 is converted to a digital signal in the analog-to-digital (A/D) converter 206, and the controller 200 detects the resistance $R_X$ from the digital signal received from the analog-to-digital (A/D) converter 206. The resistance $R_X$ is stored by the controller 200 in a predetermined area of the memory 202. In step 613 of FIG. 6, the controller 200 determines the composite resistance $R_S$ of the paper specific resistance $R_P$ and the resistance $R_X$ between the transfer roller 136 and the photosensitive drum 133 as follows:

$R_S = R_P + R_X$.

In step 615 of FIG. 6, the controller 200 applies a transfer voltage to the transfer roller 136 when the paper P as the printing medium passes between the transfer roller 136 and the photosensitive drum 133 on the basis of the composite resistance $R_S$, the composite resistance $R_S$ being stored in a predetermined area of the memory 202 by the controller 200. In consideration of variation of image quality depending on paper type or paper status, the paper type or status is detected in advance before the paper passes through the transfer roller 136 and the photosensitive drum 133, and the transfer voltage is provided to the transfer roller 136 based on the detected paper type or status. In step 617, the controller 200 has the paper P printed and completes the printing process.

In a laser beam printer (LBP) of the present invention as described above, the specific resistance of the printing medium, such as paper, fed to feed rollers is obtained and fed to a transfer roller before the printing medium, such as paper, reaches the transfer roller, so that the transfer roller operates based on a printing medium type or status, such as a paper type or status. As a result, high quality images can be obtained.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from scope thereof. Therefore, it is intended that the present invention not to be limited to the particular embodiments disclosed as the best mode contemplated for carrying out the present invention, but that the present invention includes all embodiments falling within the scope of the appended claims.

What is claimed is:

1. A method of controlling a transfer voltage in a laser beam printer, comprising the steps of:

detecting a resistance of feed rollers as a first resistance before a paper sheet passes between the feed rollers;

detecting a resistance of the paper sheet and the feed rollers as a second resistance when the paper sheet passes between the feed rollers;

obtaining a specific resistance of the paper sheet as a third resistance by determining the difference between the first resistance and the second resistance;

detecting a resistance between a transfer roller and a photosensitive drum as a fourth resistance before the paper sheet passes between the transfer roller and the photosensitive drum;

obtaining a composite resistance as a fifth resistance by adding the third resistance to the fourth resistance; and printing on the paper sheet by applying a transfer voltage to the transfer roller based on the fifth resistance.

2. The method of claim 1, wherein the feed rollers comprises a conductive rubber material.

3. The method of claim 2, further comprised of the first resistance being detected by applying a feed roller voltage to the feed rollers, measuring a current flowing through the feed rollers, and determining the resistance of the feed rollers based upon the current flowing through the feed rollers.

4. The method of claim 3, further comprised of the second resistance being detected by applying the feed roller voltage to the feed rollers when a leading edge of the paper sheet is introduced between the feed rollers, measuring a current flowing in the feed rollers as the paper sheet passes between the feed rollers, and determining the resistance of the feed rollers and the paper sheet passing between the feed rollers based upon the current flowing in the feed rollers as the paper sheet passes between the feed rollers.

5. The method of claim 4, further comprised of the fourth resistance being detected by applying a predetermined transfer voltage to the transfer roller, measuring a current between the transfer roller and the photosensitive drum, and determining the resistance between the transfer roller and the photosensitive drum based upon the current between the transfer roller and the photosensitive drum.

6. The method of claim 5, wherein the transfer voltage based on the fifth resistance corresponds to the composite resistance.

7. The method of claim 6, wherein the feed roller voltage is a high voltage corresponding to a first pulse amplitude modulation signal and the transfer voltage is a high voltage corresponding to a second pulse amplitude modulation signal.

8. The method of claim 1, further comprised of the first resistance being detected by applying a feed roller voltage to the feed rollers, measuring a current flowing through the feed rollers, and determining the resistance of the feed rollers based upon the current flowing through the feed rollers.

9. The method of claim 8, further comprised of the second resistance being detected by applying the feed roller voltage to the feed rollers when a leading edge of the paper sheet is introduced between the feed rollers, measuring a current flowing in the feed rollers as the paper sheet passes between the feed rollers, and determining the resistance of the feed rollers and the paper sheet passing between the feed rollers based upon the current flowing in the feed rollers as the paper sheet passes between the feed rollers.

10. The method of claim 9, further comprised of the fourth resistance being detected by applying a predetermined transfer voltage to the transfer roller, measuring a current between the transfer roller and the photosensitive drum, and determining the resistance between the transfer roller and the photosensitive drum based upon the current between the transfer roller and the photosensitive drum.

11. The method of claim 10, wherein the transfer voltage based on the fifth resistance corresponds to the composite resistance.

12. The method of claim 11, wherein the feed roller voltage is a high voltage corresponding to a first pulse amplitude modulation signal and the transfer voltage is a high voltage corresponding to a second pulse amplitude modulation signal.

13. The method of claim 1, wherein the transfer voltage based on the fifth resistance corresponds to the composite resistance.

14. A method of controlling a transfer voltage in a laser beam printer, comprising the steps of:

detecting a resistance of feed rollers as a first resistance before a printing medium passes between the feed rollers;

detecting a resistance of the printing medium and the feed rollers as a second resistance when the printing medium passes between the feed rollers;

obtaining a specific resistance of the printing medium as a third resistance by determining the difference between the first resistance and a second resistance;

detecting a resistance between a transfer roller and a photosensitive drum as a fourth resistance before the printing medium passes between the transfer roller and the photosensitive drum;

obtaining a composite resistance as a fifth resistance by adding the third resistance to the fourth resistance; and printing on the printing medium by applying a transfer voltage to the transfer roller based on the fifth resistance.

15. The method of claim 14, wherein the feed rollers comprise a conductive rubber material.

16. The method of claim 14, further comprised of the first resistance being detected by applying a feed roller voltage to the feed rollers, measuring a current flowing through the feed rollers, and determining the resistance of the feed rollers based upon the current flowing through the feed rollers.

17. The method of claim 16, further comprised of the second resistance being detected by applying the feed roller voltage to the feed rollers when a leading edge of the printing medium is introduced between the feed rollers, measuring a current flowing in the feed rollers as the printing medium passes between the feed rollers, and determining the resistance of the feed rollers and the printing medium passing between the feed rollers based upon the current flowing in the feed rollers as the printing medium passes between the feed rollers.

18. The method of claim 17, further comprised of the fourth resistance being detected by applying a predetermined transfer voltage to the transfer roller, measuring a current between the transfer roller and the photosensitive drum, and determining the resistance between the transfer roller and the photosensitive drum based upon the current between the transfer roller and the photosensitive drum.

19. The method of claim 18, wherein the transfer voltage based on the fifth resistance corresponds to the composite resistance.

20. The method of claim 19, wherein the feed roller voltage is a high voltage corresponding to a first pulse amplitude modulation signal and the transfer voltage is a high voltage corresponding to a second pulse amplitude modulation signal.

21. The method of claim 20, wherein the feed rollers comprise a conductive rubber material.

22. The method of claim 18, wherein the feed rollers comprise a conductive rubber material.

23. The method of claim 14, wherein the transfer voltage based on the fifth resistance corresponds to the composite resistance.

24. An apparatus for controlling a transfer voltage in a laser beam printer, comprising:

a controller controlling the recording of an image on a printing medium, the controller generating a first control signal to control a feed roller voltage to be applied to feed rollers of the laser beam printer and generating a second control signal to control a transfer voltage to be applied to a transfer roller of the laser beam printer, the controller determining a specific resistance of the printing medium as a difference between a first detected resistance of the feed rollers without being in contact with the printing medium and a second detected resistance of the feed rollers and the printing medium in contact with the feed rollers, the controller determining a composite resistance by adding said specific resistance of the printing medium to a third detected resistance, the third detected resistance being a resistance between the transfer roller and a photosensitive drum of the laser beam printer without being in contact with the printing medium, and the controller generating a said second control signal to apply a transfer voltage to the transfer roller for printing on the printing medium based upon said composite resistance; and a high voltage supply circuit coupled to said controller, said high voltage supply circuit generating said feed roller voltage to be applied to the feed rollers corresponding to a said first control signal from said controller, generating said transfer voltage to be applied to the transfer roller corresponding to a said second control signal from said controller, and detecting said first detected resistance, said second detected resistance and said third detected resistance and providing said first detected resistance, said second detected resistance and said third detected resistance to said controller.

25. The apparatus of claim 24, wherein said printing medium comprises a paper sheet.

26. The apparatus of claim 24, further comprising a sensor coupled to said controller to sense the introduction of a leading edge of the printing medium between the feed rollers.

27. The apparatus of claim 26, wherein said printing medium comprises a paper sheet.

28. The apparatus of claim 24, further comprising a memory coupled to said controller, said memory for storing a program to control provision of the transfer voltage and for storing respective values of said first detected resistance, said second detected resistance, said third detected resistance, said specific resistance of the printing medium and said composite resistance.

29. The apparatus of claim 28, wherein said printing medium comprises a paper sheet.

30. The apparatus of claim 24, wherein said high voltage supply circuit comprises:

a first transformer including a first primary winding for receiving a voltage from a power supply and a first secondary winding for generating a higher voltage than a voltage on the first primary winding;

a first diode coupled to the first primary winding and to a ground for clipping a voltage induced from the first primary winding to the first secondary winding;

a first transistor having a base for receiving a said first control signal from said controller, a collector coupled to the first primary winding and an emitter connected to the ground, for selectively controlling the voltage on the first primary winding to be induced to the first secondary winding based on a said first control signal;

a second diode having an anode coupled to the first secondary winding for rectifying a voltage induced to the first secondary winding;

a first smoothing capacitor for smoothing a rectified voltage and being connected to the second diode and to the first secondary winding for supplying the feed roller voltage to the feed rollers;

a first resistor coupled between the first secondary winding and the ground for detecting a current flowing through the feed rollers, wherein a voltage used for detecting the specific resistance of the printing medium is output based on the current flowing through the first resistor;

a second transformer including a second primary winding for receiving a voltage from the power supply and a second secondary winding for generating a higher voltage than a voltage on the second primary winding;

a third diode coupled to the second primary winding and to the ground for clipping a voltage induced from the second primary winding to the second secondary winding;

a second transistor having a base for receiving a said second control signal from the controller, a collector coupled to the second primary winding and a emitter connected to the ground for selectively controlling the voltage of the second primary winding to be induced in the second secondary winding based on a said second control signal;

a fourth diode having an anode coupled to the second secondary winding for rectifying a voltage induced to the second secondary winding;

a second capacitor for smoothing a rectified voltage and for supplying the transfer voltage to the transfer roller, the second capacitor being connected to the fourth diode and to the second secondary winding; and a second resistor coupled between the second secondary winding and the ground for detecting a current flowing through the transfer roller, wherein a voltage indicating said third detected resistance between the transfer roller and the photosensitive drum is output based on the current flowing through said second resistor.

31. The apparatus of claim 30, wherein said printing medium comprises a paper sheet.

32. The apparatus of claim 30, further comprising a memory coupled to said controller, said memory for storing a program to control provision of the transfer voltage and for storing respective values of said first detected resistance, said second detected resistance, said third detected resistance, said specific resistance of the printing medium and said composite resistance.

33. The apparatus of claim 32, further comprising a sensor coupled to said controller to sense the introduction of a leading edge of the printing medium between the feed rollers.

34. The apparatus of claim 33, wherein said printing medium comprises a paper sheet.

35. An apparatus for controlling a transfer voltage in a laser beam printer, comprising:

means for detecting a resistance of feed rollers as a first resistance before a paper sheet passes between the feed rollers;

means for detecting a resistance of the paper sheet and the feed rollers as a second resistance when the paper sheet passes between the feed rollers;

means for obtaining a specific resistance of the paper sheet as a third resistance by determining the difference between the first resistance and the second resistance;

means for detecting a resistance between a transfer roller and a photosensitive drum as a fourth resistance before the paper sheet passes between the transfer roller and the photosensitive drum;

means for obtaining a composite resistance as a fifth resistance by adding the third resistance to the fourth resistance; and means for applying a transfer voltage to the transfer roller based on the fifth resistance for printing on the paper sheet.

36. The apparatus of claim 35, wherein the feed rollers comprise a conductive rubber material.

* * * * *